US007287963B2

(12) United States Patent
Basora

(10) Patent No.: US 7,287,963 B2
(45) Date of Patent: Oct. 30, 2007

(54) FAST PUMP PRIMING

(75) Inventor: Phillip Basora, Oceanside, CA (US)

(73) Assignee: Dimension One Spas, Vista, CA (US)

( * ) Notice: Subject to any disclaimer, the term of this patent is extended or adjusted under 35 U.S.C. 154(b) by 660 days.

(21) Appl. No.: 10/676,111

(22) Filed: Sep. 30, 2003

(65) Prior Publication Data

US 2005/0069421 A1 Mar. 31, 2005

(51) Int. Cl.
*F04B 23/04* (2006.01)

(52) U.S. Cl. ..... 417/199.2

(58) Field of Classification Search ..... 417/199.2, 417/205, 244, 250, 251
See application file for complete search history.

(56) References Cited

U.S. PATENT DOCUMENTS 3,578,880 A * 5/1971 Cygnor ..... 417/199.2
3,644,061 A * 2/1972 McFarlin ..... 417/199.2
4,558,992 A * 12/1985 Hamano et al. ..... 417/250
5,422,014 A * 6/1995 Allen et al. ..... 210/743
5,509,779 A 4/1996 Mori et al.
5,513,959 A 5/1996 Mabillot et al.
5,620,309 A 4/1997 Todden et al.
5,665,228 A 9/1997 Leaverton et al.
6,250,889 B1 6/2001 Shepard
6,454,523 B1 9/2002 Loyd et al.
6,585,493 B2 * 7/2003 Sutton ..... 417/199.2
7,044,716 B2 * 5/2006 Fabry ..... 417/244

FOREIGN PATENT DOCUMENTS

JP 9-264285 * 10/1997

* cited by examiner

*Primary Examiner*—Michael Koczo
(74) *Attorney, Agent, or Firm*—Fish & Richardson P.C.

(57) ABSTRACT

A pump priming system may include two or more pumps. In one example, a system for pump priming can include a first pump and a second pump. Each pump can have an inlet adapted for a suction force and an outlet adapted for a pressure force. The system can include a tube or bleeder, in which a first end of the tube is connected to the outlet of the first pump and a second end of the tube is connected to the inlet of the second pump. The tube can be adapted for a flow from the first pump to the second pump. The tube can be capable of removing air from the first and second pumps.

23 Claims, 5 Drawing Sheets

FAST PUMP PRIMING

TECHNICAL FIELD

This invention relates to pumps, and more particularly to fluid pump priming.

BACKGROUND

Before starting a fluid pump-for the first time, the pump and/or one or more connections to the pump are oftentimes filled with air. As shown in FIG. 1, in the case of a spa, tub, or pool, for example, when the spa is filled with water 120, air can be trapped in the plumbing 105. If there is too much air in the pump 110, the pump 110 will not start to function properly.

The process of priming involves removing air out of plumbing and/or pump to fill the plumbing with fluid so that a pumping or siphoning action can occur. A conventional method of priming can include opening an outlet 103 (e.g., a bleeder, or tube or pipe outlet) to allow the trapped air in the plumbing and/or pump to escape. The bleeder 103 may have an opening 106 on the topside of the spa to so that the air will escape into the atmosphere.

However, sometimes the air still does not leave the plumbing. In such a case, additional labor may be required to prime the pump. A portion of the spa may have to be accessed to manually release or force out the trapped air. In one instance, a portion of the spa has to be removed so that the pump may be accessed. The pump may have a bleeder at the top portion of the pump that can be opened to release the air.

In another instance, a pump union may have to be loosened to allow water to fill the pump. FIG. 2 shows a diagram of an exemplary pump union 200. The pump union 200 is a screw joint in the plumbing that allows the pump to be removed from the plumbing hose. This joint can be hand tightened (or loosened) to attach (or detach) the pump from the hose. The pump's "union" can also be referred to as the connection between the pressure (e.g., outlet) and the suction (e.g., inlet) of the pump.

In both instances, extra time and labor are used to prime the pump.

SUMMARY

The present disclosure relates to priming in a multi-pump system. In one implementation, a system for pump priming includes a first pump and a second pump, in which the first and second pumps both include an inlet and an outlet. The inlet can be adapted to a suction force and the outlet can be adapted to a pressure force. The system can also include a tube, in which a first end of the tube is connected to the outlet of the first pump and a second end of the tube is connected to the inlet of the second pump. The tube can be adapted for a flow from the first pump to the second pump and can be capable of removing air from any one of those pumps. The tube can be a bleeder and can have a smaller diameter than the diameters of the inlets and outlets of the first and second pumps. In one case, for example, the diameter of the bleeder is ⅜ inches.

The system can force air out of any one of the pumps. The system can also suction air out of any one of the first and second pumps and fill those pumps with fluid (e.g., water). The system can utilize a push force of the first pump and a pull force of the second pump to remove air out of any one of the first and second pumps and fill those pumps with fluid.

In another implementation, a multi-pump system for pump priming includes two or more fluid pumps, in which each fluid pump includes an inlet and an outlet. Each inlet can be adapted to a suction force and each outlet can be adapted to a pressure force. The multi-pump system also includes at least one tube or bleeder configured to remove air from the two or more fluid pumps. The tube can be connected between the two or more fluid pumps, in which a first end of the tube is connected to the outlet of a fluid pump and a second end of the tube is connected to the inlet of a different fluid pump. The tube can be adapted for a flow from the fluid pump to the different fluid pump. The tube can have a smaller diameter than the diameters of the inlets and outlets of the two or more fluid pumps. In one case, two or more of the tubes can be connected in a daisy-chain arrangement, in which the tube connections are in series between the inlet of one of the fluid pumps and the outlet of one of a different fluid pump. The multi-pump system can allow the two or more pumps to be primed simultaneously.

In another implementation, the system includes a spa. The spa can include at least two fluid pumps, in which the fluid pumps include an inlet and an outlet. Each inlet can be configured for a suction force and each outlet can be configured for a pressure force. The system also includes at least one bleeder connected between an outlet of one of the fluid pumps and an inlet of a different fluid pump. The bleeder can remove air from at least one of the fluid pumps and assist in priming at least one of the fluid pumps. The system also includes a fluid circulation system connected to at least one of the pumps. The fluid circulation system may include one or more filters.

The present disclosure offers one or more advantages over the conventional pump priming. In one instance, no additional labor is required in multi-pump systems to start at least one fluid pump—the pump(s) can be self-priming. A button or start indicator can be selected and the pump priming process can begin automatically without additional manual effort of priming. Hence, a spa or pool user does not have to perform priming functions for a multi-pump system and/or does not have to request priming support services. Moreover, the self-priming system can be performed quickly to begin proper pump operation.

The details of one or more embodiments are set forth in the accompanying drawings and the description below. Other features, objects, and advantages will be apparent from the description and drawings, and from the claims.

DRAWING DESCRIPTIONS

Like reference symbols in the various drawings may indicate like elements.

DETAILED DESCRIPTION

The following description includes systems, methods, and techniques related to pump priming for multi-pump systems.

Figure 1:
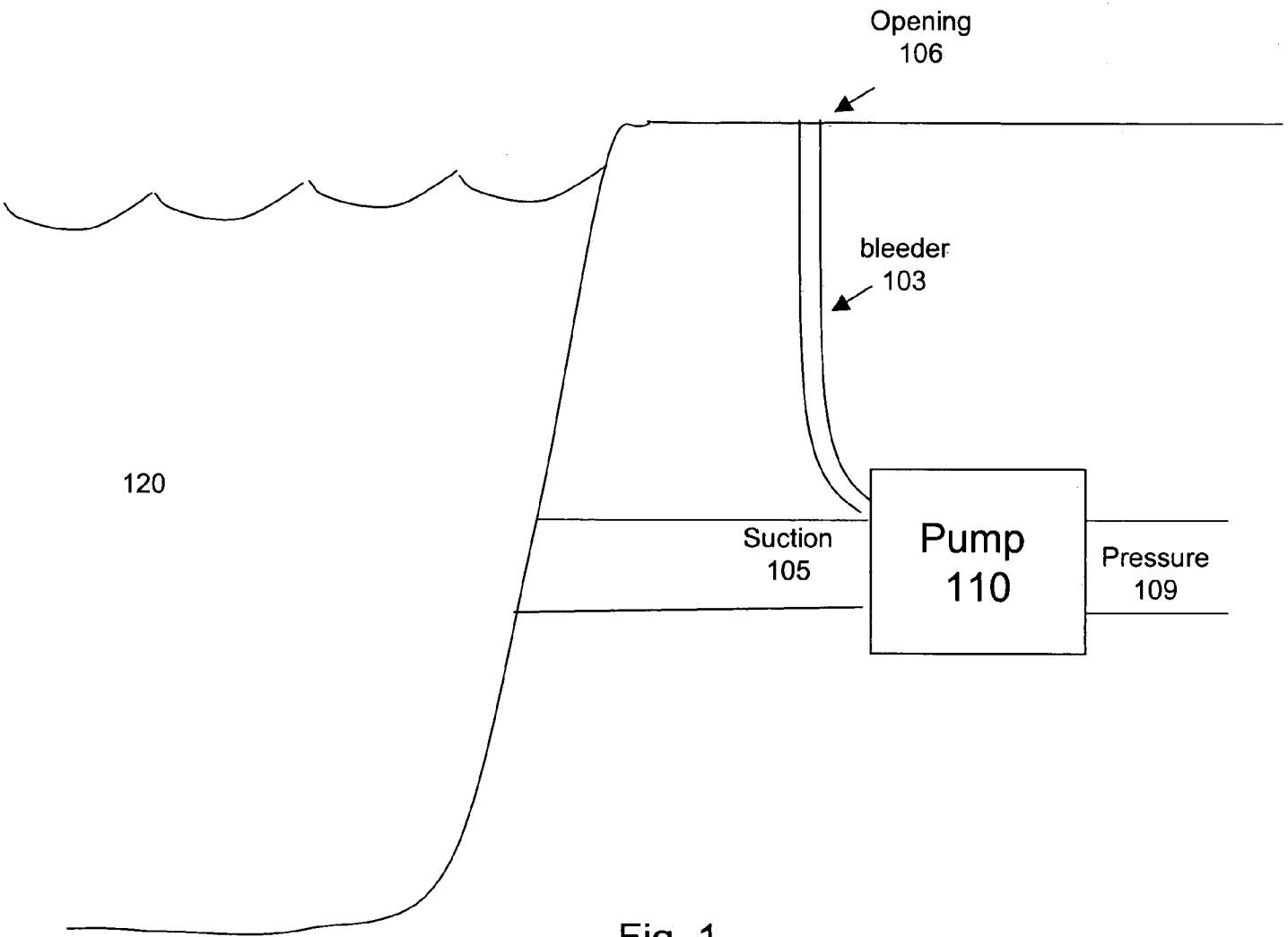
FIG. 1 is an exemplary diagram of a pumping system.
Figure 2:
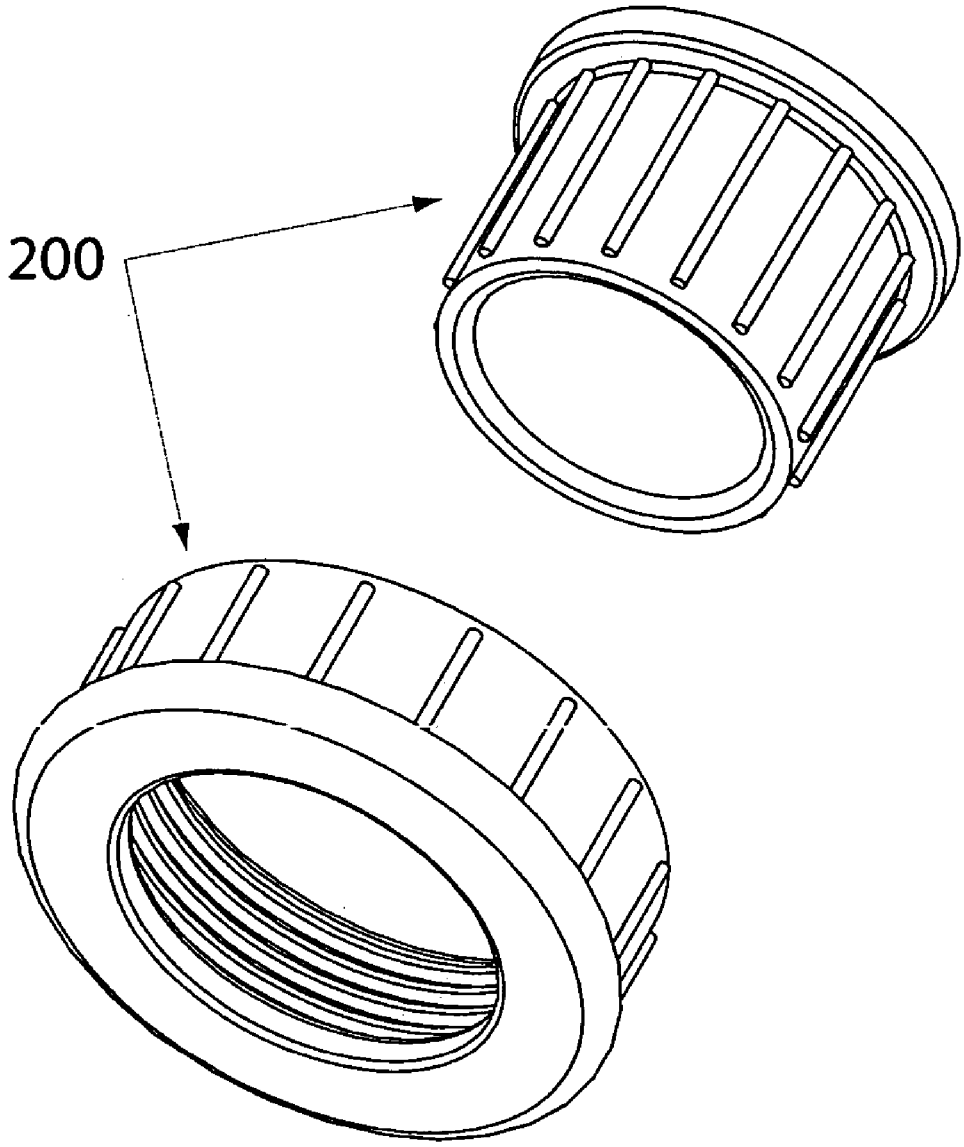
FIG. 2 is an exemplary diagram of a pump union.

In some fluid systems, such as pools, tubs, and spas, one or more pumps are used to circulate the water. In circulating the water, the water may be sucked from a section of the spa through an opening 105 and sent through a pump 110 to another destination through an outlet 109 (FIG. 1). Typically, the water can be filtered to remove particles and debris during circulation. The filtration system may also reduce bacteria by, for example, introducing ozone in the filtered water. The circulation system may also have a heater (not shown) to warm the water to a certain temperature (e.g., above 90° F.). The circulation system may also have one or more water jets to inject the filter ed water back into the spa.

Some of these fluid systems have more than one pump. In such a system, each of these pumps may need to be primed to function properly. In such a case, a multi-pump system can provide self-priming functionality, in which one pump can be used to prime another pump.

Figure 3:
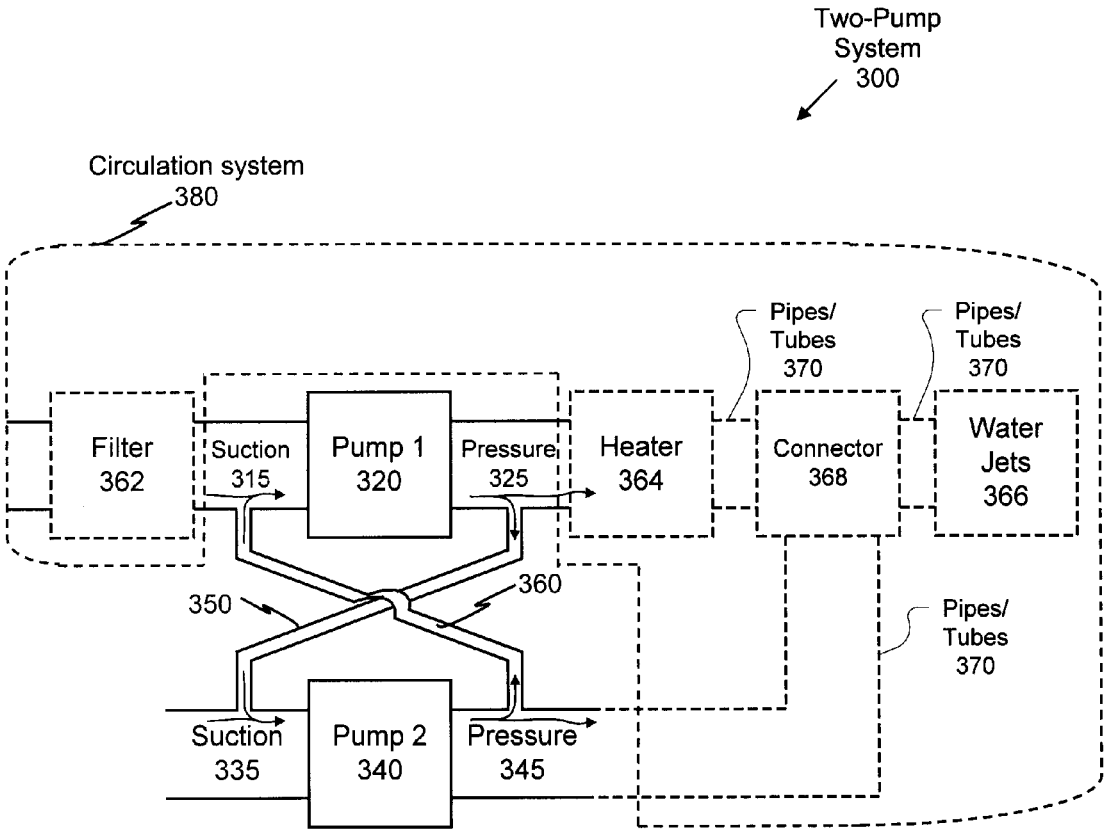
FIG. 3 is an exemplary diagram of a two-pump system.

FIG. 3 shows a diagram of a two-pump system 300. The two-pump system includes a first pump 320, Pump 1, and a second pump 340, Pump 2. Both of the pumps 320, 340 have a suction (or inlet) section 315, 335, and a pressure (or outlet) section 325, 345. The suction and pressure sections may be connected to any part of the spa or a circulation system 380 with various filters 362, heaters 364, water jets 366, tubes 370, pipes 370, and connectors.

By itself, one pump may not produce enough force to be able to pushed trapped air and/or perform priming. However, two (or more) pumps can generate enough force to push (or suck) the air out for proper priming. In FIG. 3, priming can be performed between the pumps by the dual acts of (1) pushing or forcing the air out of the plumbing and/or pump in a particular direction with one pump, while (2) suctioning the air out of the plumbing and/or pump in the same direction with another pump. The trapped air can be pushed with the pressure from one pump (e.g., Pump 1) and sucked with the suction of the second pump 340 (Pump 2)—so that the air can be moved in a direction with both a pushed force and a pulling force.

The pressure sections 325, 345 and suction sections 315, 335 of the pumps 320, 340 can be indirectly connected in the plumbing through a bleeder 350, 360. The bleeder 350, 360 can siphon or drain off the trapped air (and/or fluid) through the pressure section 325,345 of one pump to travel to the suction section 315,335 of another pump. The trapped air can then be sent out through a pump pressure opening and into the spa or another exit in the fluid circulation system. The trapped air can also be sent through a bleeder (e.g., 103) on the top portion of the second pump to an opening at the top of the spa or another exit.

In one implementation, the bleeder 350, 360 can have a smaller diameter than the tubing or piping for the pressure or suction sections. For instance, the diameter of the suction may be ⅜ inches (or 9.525 millimeters) and the pressure and/or suction sections may be 2½ inches (or 63.5 millimeters). After the trapped air is removed through the bleeders, proper pumping operation commences, and the majority of the fluid can flow through the pressure sections 325, 345 and suction sections 315, 335 of the pumps 320, 340.

Because the push-pull forces of the two pumps can move air more quickly than either the push or pull force of a single pump, the priming can be performed quickly with two pumps.

Figure 4:
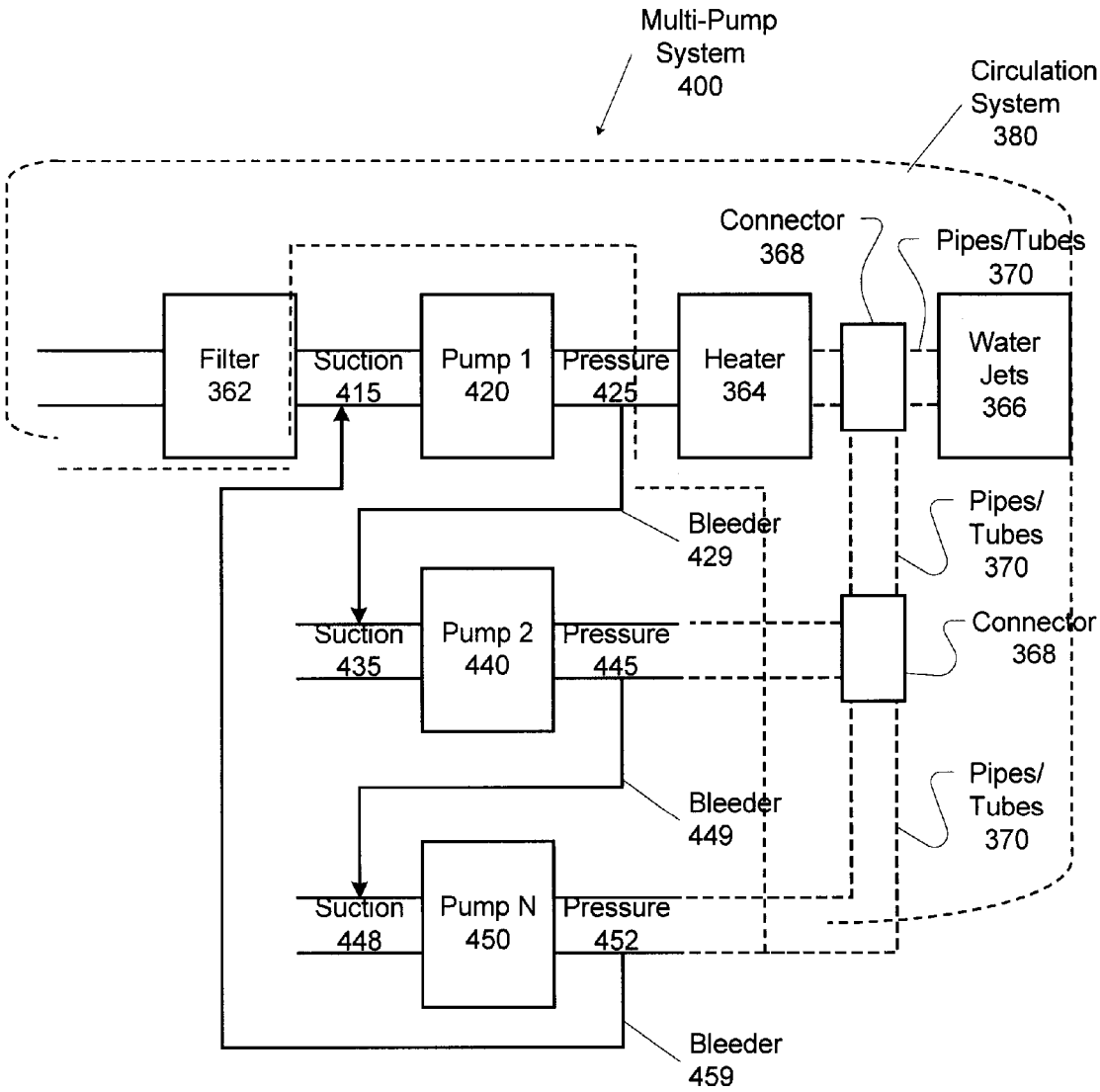
FIG. 4 is an exemplary diagram of a multi-pump system.

FIG. 4 shows another priming implementation in a multi-pump system. In the case of more than two pumps, bleeders can be connected in a daisy-chain arrangement, in which the bleeders are connected in series between the pressure section of one pump to the suction section of another pump. The daisy-chain arrangement for the bleeder connections can have the advantage of utilizing the push-pull forces as described in relation to FIG. 3.

FIG. 4 shows a multi-pump system with a multiple number (e.g., N number) of pumps and a multiple number (e.g., N number) of corresponding bleeders between the pumps. As in FIG. 1, the suction and pressure sections of each pump can connect to any other portion of the spa, plumbing, and/or circulation system 380. The pressure section 425 of a first pump 420 (Pump 1) can be connected to the suction section 435 of a second pump 440 (Pump 2) through a first bleeder 429. The first bleeder 420 can drain away (e.g., remove) trapped air in the pressure 425 of the first pump 420 to the suction 435 of the second pump 440. The bleeders 429, 449, 459 in FIG. 4 are drawn with respect to the direction of flow through those bleeders.

The pressure section 445 of the second pump 440 (Pump 2) can be connected to the suction section 448 of another pump 450 (Pump N) through a second bleeder 449, and so on for other pumps. The last pump 450 (Pump N) can have a pressure section 452 that is connected to the suction section 415 of the first pump 420 (Pump 1).

Such an arrangement as shown in FIG. 4 can provide the advantages of (1) priming multiple pumps, (2) priming those multiple pumps simultaneously, and (3) eliminating the labor and effort of priming one or more pumps by, for example, opening an equipment compartment to loosen one or more pump unions. The daisy-chain arrangement for the bleeder connections between multiple pumps can allow those pumps to be self-priming.

Figure 5:
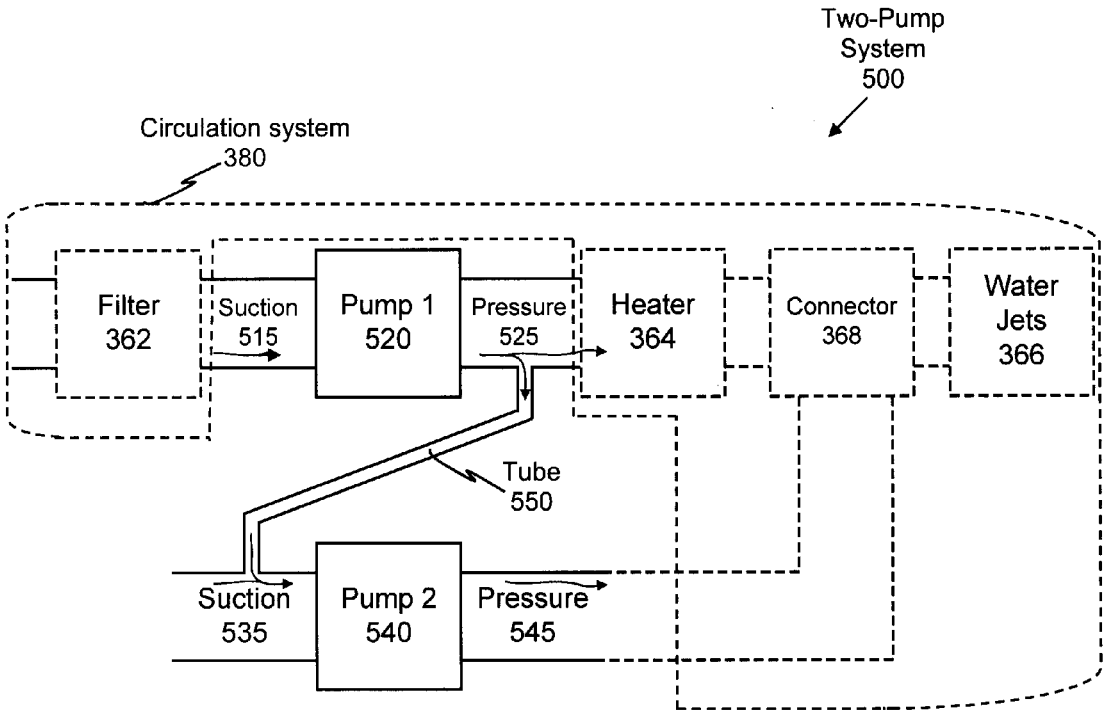
FIG. 5 is an exemplary diagram of a two-pump system showing a single tube.

FIG. 5 shows another priming implementation in a multi-pump system 500. Two pumps including pump 1 (520) and pump 2 (540) are connected to a circulation system 380. The circulation system 380 includes at least one of a filter 362, a heater 364, a connector 368 and a water jet 366. The outlet 525 of pump 1 (520) adapted to a pressure force is connected to a first end of tube 550, and an inlet of pump 2 (540) adapted to a suction force is connected to a second end of the tube 550 to provide a fluid path separate from the inlets 515, 535 and outlets 525, 545. The tube 550 is designed to provide a flow from pump 1 (520) to pump 2 (540). When pump 1 (520) is at least partially filled with water, pump 1 (520) supplies at least water to pump 2 (540) by using the pressure force of the outlet of pump 1 (520) to push at least water from the outlet of pump 1 (520). Through the tube 550 and into the inlet of pump 2 (540). When pump 2 (540) is at least partially filled with water, pump 2 (540) supplied at least water to pump 1 (520) by using the suction force of the inlet of pump 2 (540) to suction at least water through the tube 550 and out from the outlet of pump 1 (520).

A number of embodiments of the invention have been described. Nevertheless, it will be understood that various modifications may be made without departing from the spirit and scope of the invention. For example, although FIG. 4 shows a daisy-chain or serial bleeder arrangement between multiple pumps, other bleeder arrangements may be constructed to provide a flow through those bleeders by utilizing push-pull forces between pumps. For instance, a pressure section of a first pump may have a first bleeder connection to a suction section of a second pump, in addition to having a second bleeder connection from the pressure section of the first pump to the suction section of a third pump. Hence, air can be removed from a first pump by two bleeders connected to the pressure section of the first pump, with each bleeder connected to a suction section of different pumps. In another example, although the pump priming system has been described in relation to pools, spas, and tubs, the system can be used in other fluid systems, such as tanks, fluid reservoirs, and fluid compartments. Accordingly, other embodiments are within the scope of the following claims.

What is claimed is:

1. A system for pump priming comprising:

a first pump, the first pump comprising an inlet and an outlet, wherein the inlet is adapted to a suction force that suctions at least water into the first pump and the outlet is adapted to a pressure force that pushes at least water away from the first pump;

a second pump, the second pump physically separated from the first pump and comprising an inlet and an outlet, wherein the inlet is adapted to a suction force that suctions at least water into the second pump and the outlet is adapted to a pressure force that pushes at least water away from the second pump; and a tube comprising a first end connected to the outlet of the first pump and a second end connected to the inlet of the second pump to provide a fluid path separate from the inlets and the outlets of the first and second pumps, wherein the tube is configured to enable a flow from the first pump to the second pump comprising when the first pump is at least partially filled with water, supplying at least water to the second pump by using the pressure force of the outlet of the first pump to push at least water from the first pump through the tube and into the inlet of the second pump; and when the second pump is at least partially filled with water, supplying at least water to the first pump by using the suction force of the inlet of the second pump to suction at least water through the tube and out of the outlet of the first pump.

2. The system of claim 1 wherein the tube comprises a smaller diameter than of any one of a diameter of the inlet and a diameter of the outlet of either the first and second pumps.

3. The system of claim 2 wherein the diameter of the tube is ⅜ inches.

4. The system of claim 1 wherein the system is adapted to force air out of any one of the first and second pumps by supplying water from another of the first and second pumps, wherein the system is further adapted for suctioning air out of any one of the first and second pumps by using a suction force created based on water flowing through another of the first and second pumps.

5. The system of claim 1 wherein the system is adapted to utilize a push force of the first pump when at least partially filled with water and a pull force of the second pump when at least partially filled with water to remove air out of any one of the first and second pumps.

6. The system of claim 5 wherein the system is further adapted to utilize a push force of the first pump when at least partially filled with water and a pull force of the second pump when at least partially filled with water to fill any one of the first and second pumps with at least water.

7. The system of claim 1 wherein the first pump is adapted to prime the second pump, and wherein the second pump is adapted to prime the first pump.

8. The system of claim 1 wherein the inlets and outlets of the first and second pumps are connected to a circulation system comprising tubes, pipes, and connectors.

9. The system of claim 1, further comprising another tube that includes a first end connected to the outlet of the second pump and a second end connected to the inlet of the first pump to provide another fluid path separate from the tube and the inlets and the outlets of the pumps, wherein the another tube is adapted for a flow from the second pump to the first pump comprising when the second pump is at least partially filled with water, supplying water to the first pump by using the pressure force of the outlet of the second pump to push at least water from the first pump through the another tube and into the inlet of the first pump; and when the first pump is at least partially filled with water, supplying water to the second pump by using the suction force of the inlet of the first pump to suction at least air through the another tube and out of the outlet of the second pump.

10. A multi-pump system for pump priming comprising:

three or more fluid pumps, wherein each fluid pump comprises an inlet and an outlet, wherein each inlet is adapted to a suction force that suctions at least water into each fluid pump and each outlet is adapted to a pressure force that pushes at least water away from each fluid pump;

a first tube comprising a first end connected to the outlet of a first one of the fluid pumps and a second end connected to the inlet of a second one of the fluid pumps;

a second tube comprising a first end connected to the outlet of the second fluid pump and a second end connected to the inlet of a third one of the fluid pumps; and an $N^{th}$ tube comprising a first end connected to the outlet of the N one of the fluid pumps and a second end connected to the inlet of the first fluid pump;

wherein each tube provides a fluid path separate from other tubes and the inlets and outlets of the fluid pumps, and provides a flow between at least two of the fluid pumps comprising when at least one of the fluid pumps is at least partially filled with water, supplying water to at least another one of the fluid pumps by using the pressure force of the outlet of the fluid pump that is at least partially filled with water to push at least water from the fluid pump that is at least partially filled with water through at least one of the tubes and into the inlet of at least another one of the fluid pumps.

11. The multi-pump system of claim 10 wherein each tube comprises a smaller diameter than any one of the inlets or the outlets.

12. The multi-pump system of claim 10 wherein two or more of the tubes are connected in a daisy-chain arrangement, wherein the tube connections are in series between the inlet of one of the fluid pumps and the outlet of one of a different fluid pump.

13. The multi-pump system of claim 10 wherein the system is adapted for self-priming at least one fluid pump.

14. A method for multi-pump priming comprising:

connecting a first pump with a second pump, wherein each pump comprises an inlet and an outlet, wherein each inlet is adapted to a suction force that suctions at least water into each pump and each outlet is adapted to a pressure force that pushes at least water away from each pump including providing a first fluid path different from the inlets and outlets by connecting a first end of a tube to the outlet of the first pump adapted to the pressure force and a second end of the tube to the inlet of the second pump adapted to the suction force;

when the first pump is at least partially filled with water, supplying water to the second pump by pushing at least water out of the outlet of the first pump through the first fluid path and into the inlet of the second pump; and when the second pump is at least partially filled with water, supplying water to the first pump by suctioning at least air through the first fluid path and out of the outlet of the pump.

15. The method of claim 14 wherein providing a first fluid path comprises connecting a first end of a tube that comprises a smaller diameter than any one of the inlets or the outlets of the first and second pumps.

16. The method of claim 15 further comprising self-priming the first and second pumps.

17. The method of claim 14 further comprising connecting the inlets and outlets of the first and second pumps are connected to a fluid circulation system comprising tubes, pipes, and connectors.

18. The method of claim 14 further comprising pumping water through the tube after the air exits the first pump.

19. The method of claim 14, further comprising providing a second fluid path different from the inlets and outlets of the pumps by connecting a first end of another tube to the outlet of the second pump and a second end of the another tube to the inlet of the first pump.

20. A system comprising a spa, the spa comprising:

at least two physically separated fluid pumps, wherein each of the fluid pumps comprises an inlet and an outlet, wherein each inlet is configured for a suction force that suctions at least water into its pump and each outlet is configured for a pressure force that pushes at least water away from its pump;

at least one tube connected between an outlet of one of the fluid pumps and an inlet of a different fluid pump to provide a fluid path separate from the inlets and the outlets of the fluid pumps, the at least one tube being adapted to remove at least air from at least one of the fluid pumps by performing operations comprising when a first one of the pumps is at least partially filled with water, supplying water to a second one of the pumps by using the pressure force of the outlet of the first pump to push at least water from the first pump through the at least one tube and into the inlet of the second pump; and when the second pump is at least partially filled with water, supplying water to the first pump by using the suction force of the inlet of the second pump to suction at least air through the at least one tube and out of the outlet of the first pump, wherein the at least one tube is further adapted for priming at least one of the fluid pumps; and a fluid circulation system, wherein the fluid circulation system comprises one or more filters, wherein the circulation system is connected to at least one of the fluid pumps.

21. The system of claim 20 wherein the at least one tube comprises a smaller diameter than of any one of the inlets and the outlets of the fluid pumps.

22. The system of claim 20 wherein the fluid circulation system further comprises a heater and a water jet.

23. The system of claim 20 wherein the fluid pumps comprise self-priming pumps.

* * * * *